US006752944B2

(12) United States Patent
Jewell et al.

(10) Patent No.: US 6,752,944 B2
(45) Date of Patent: Jun. 22, 2004

(54) METHOD FOR MAKING CROSSLINKED FIBERS HAVING HIGH WET BULK

(75) Inventors: Richard A. Jewell, Bellevue, WA (US); John A. Westland, Auburn, WA (US)

(73) Assignee: Weyerhaeuser Company, Federal Way, WA (US)

( * ) Notice: Subject to any disclaimer, the term of this patent is extended or adjusted under 35 U.S.C. 154(b) by 16 days.

(21) Appl. No.: 10/228,792

(22) Filed: Aug. 27, 2002

(65) Prior Publication Data

US 2003/0008580 A1 Jan. 9, 2003

Related U.S. Application Data

(62) Division of application No. 09/690,136, filed on Oct. 16, 2000, now Pat. No. 6,551,706, which is a continuation of application No. 09/240,085, filed on Jan. 29, 1999, now Pat. No. 6,207,278.

(51) Int. Cl.[7] ..... D01F 2/00; D21H 11/20

(52) U.S. Cl. ..... 264/137; 162/9; 162/157.6; 162/182; 264/160; 264/236

(58) Field of Search ..... 264/137, 160, 264/236; 162/9, 157.6, 182

(56) References Cited

U.S. PATENT DOCUMENTS 4,285,690 A 8/1981 North
4,332,586 A 6/1982 North
4,455,416 A 6/1984 Floyd et al.
4,472,167 A 9/1984 Welch
4,505,712 A 3/1985 Floyd et al.
4,537,634 A 8/1985 Floyd
4,547,580 A 10/1985 Floyd
4,625,029 A 11/1986 Floyd et al.
4,656,296 A 4/1987 Floyd
4,853,086 A 8/1989 Graef
5,366,591 A * 11/1994 Jewell ..... 162/9
5,447,977 A 9/1995 Hansen et al.
5,843,061 A 12/1998 Chauvette et al.
6,207,278 B1 3/2001 Jewell et al.

* cited by examiner

*Primary Examiner*—Leo B. Tentoni
(74) *Attorney, Agent, or Firm*—Christensen O'Connor Johnson Kindness PLLC

(57) ABSTRACT

The present invention provides cellulosic fibers having high wet bulk and methods for their preparation. In one embodiment, the invention provides cellulosic fibers catalytically crosslinked with glyoxal and, optionally, a glycol. In another embodiment, cellulosic fibers are crosslinked with a combination of glyoxal and a glyoxal-derived resin selected from the group consisting of a glyoxal/polyol condensate, a cyclic urea/glyoxal/polyol condensate, a cyclic urea/glyoxal condensate, and mixtures thereof.

12 Claims, No Drawings

METHOD FOR MAKING CROSSLINKED FIBERS HAVING HIGH WET BULK

CROSS-REFERENCES TO RELATED APPLICATIONS

This application is a divisional of U.S. patent application Ser. No. 09/690,136, filed Oct. 16, 2000, now U.S. Pat. No. 6,551,706, issued Apr. 22, 2003, which is a continuation of U.S. patent application Ser. No. 09/240,085, filed Jan. 29, 1999, now U.S. Pat. No. 6,207,278 B1, issued Mar. 27, 2001. The benefits of the priority of the filing dates of U.S. patent application Ser. No. 09/240,085 and U.S. patent application Ser. No. 09/690,136 are hereby claimed under 35 U.S.C. §120.

FIELD OF THE INVENTION

The present invention relates generally to cellulosic fibers and, more specifically, to crosslinked cellulosic fibers having high wet bulk.

BACKGROUND OF THE INVENTION

Cellulosic fibers are a basic component of absorbent products such as diapers. Although absorbent, cellulosic fibers tend to retain absorbed liquid and consequently suffer from diminished liquid acquisition rate. The inability of wetted cellulosic fibers in absorbent products to further acquire liquid and to distribute liquid to sites remote from liquid insult can be attributed to the loss of fiber bulk associated with liquid absorption. Bulk is a property of fibrous composites and relates to the composite's reticulated structure. A composite's ability to wick and distribute liquid will generally depend on the composite's bulk. The ability of a composite to further acquire liquid on subsequent insults will depend on the composite's wet bulk. Absorbent products made from cellulosic fluff pulp, a form of cellulosic fibers having an extremely high void volume, lose bulk on liquid acquisition and the ability to further wick and acquire liquid, causing local saturation.

Crosslinked cellulosic fibers generally have enhanced wet bulk compared to noncrosslinked fibers. The enhanced bulk is a consequence of the stiffness, twist, and curl imparted to the fiber as a result of crosslinking. Accordingly, crosslinked fibers are advantageously incorporated into absorbent products to enhance their bulk and liquid acquisition rate and to also reduce rewet.

Because absorbent products ideally rapidly acquire liquid, effectively distribute liquid to sites remote from insult, continue to acquire liquid on subsequent insult, and have low rewet, there exists a need for cellulosic fibers having wet bulk sufficient to achieve these ideal properties. The present invention seeks to fulfill these needs and provides further related advantages.

SUMMARY OF THE INVENTION

In one aspect, the present invention provides individualized cellulosic fibers having high wet bulk. The high wet bulk cellulosic fibers of the invention are glyoxal crosslinked cellulosic fibers. In one embodiment, cellulosic fibers are preferably catalytically crosslinked with a combination of glyoxal and propylene glycol. In another embodiment, the fibers are crosslinked with a combination of glyoxal and a glyoxal-derived resin selected from a glyoxal/polyol condensate, a cyclic urea/glyoxal/polyol condensate, and a cyclic urea/glyoxal condensate.

In another aspect of the invention, methods for the preparation of cellulosic fibers having high wet bulk are provided.

In the methods, a fibrous web of cellulosic fibers is treated with a glyoxal crosslinking combination, wet fiberized, and then dried and cured to provide individualized cellulosic fibers having high wet bulk. Generally, fibers prepared by the method of the invention have a wet bulk that is greater than about 20 cc/g at 0.6 kPa, or at least about 30 percent, and preferably at least about 50 percent, greater than commercially available high-bulk fibers.

DETAILED DESCRIPTION OF THE INVENTION

The present invention provides cellulosic fibers having high wet bulk and methods for their preparation. The high-wet-bulk fibers of the invention have a wet bulk that is at least about 20 percent, preferably at least about 30 percent, and more preferably about 50 percent greater than commercially available high-bulk fibers. The fibers of the invention have a wet bulk greater than about 20 cc/g, preferably greater than about 22 cc/g, and more preferably greater than about 25 cc/g at 0.6 kPa.

As used herein, the term "bulk" refers to the volume in cubic centimeters occupied by 1.0 gram of airlaid fluff pulp under a load of 0.6 kPa. The term "wet bulk" refers to the volume in cubic centimeters occupied by 1.0 gram (dry basis) of fluff pulp under load of 0.6 kPa after the pulp has been wetted with water. Wet bulk under load is measured by FAQ and reported in cc/g at 0.6 kPa as described below.

The present invention provides individualized cellulosic fibers having high wet bulk. The high-wet-bulk cellulosic fibers of the invention are glyoxal crosslinked cellulosic fibers. As used herein, the term "glyoxal crosslinked cellulosic fibers" refers to cellulosic fibers that have been treated with a glyoxal crosslinking combination as described herein.

In one embodiment, the invention provides cellulosic fibers catalytically crosslinked with glyoxal and, optionally, a glycol. Suitable glycols include ethylene glycol, diethylene glycol, propylene glycol, and dipropylene glycol. Propylene glycol is a preferred glycol. Catalysts for crosslinking include an aluminum salt of a strong inorganic acid and/or a water-soluble $\alpha$-hydroxy carboxylic acid. In a preferred embodiment, the aluminum salt is aluminum sulfate and the carboxylic acid is citric acid.

The cellulosic fibers to be crosslinked are treated with an aqueous solution of glyoxal, optionally glycol, and one or more catalysts. The fibers are treated with an effective amount of glyoxal, glycol, and catalysts to achieve the wet bulk enhancement described herein. Generally, the fibers are treated with from about 3 to about 6 percent by weight glyoxal, up to about 2 percent by weight glycol, from about 0.1 to about 2 percent by weight aluminum salt, and from about 0.1 to about 2 percent by weight carboxylic acid based on the total weight of the treated fibers. In a preferred embodiment, fibers are treated with about 3.94 percent by weight glyoxal, about 0.52 percent by weight propylene glycol, about 1.34 percent by weight aluminum sulfate, and about 1.56 percent by weight citric acid based on the total weight of the treated fibers. The wet bulk of fibers prepared from this combination was determined as described below and compared to commercially available high-bulk fibers. These crosslinked fibers exhibited a 47 percent wet-bulk enhancement compared to the commercial high-bulk fibers. The results are summarized in the Table 1 below.

In another embodiment of the invention, cellulosic fibers crosslinked with a combination of glyoxal and a glyoxal-derived resin are provided. The glyoxal-derived resins include glyoxal/polyol condensates, cyclic urea/glyoxal/polyol condensates, and cyclic urea/glyoxal condensates.

A glyoxal/polyol condensate can be prepared by reacting glyoxal with a vicinal polyol. These glyoxal/polyol condensates, substituted cyclic bis-hemiacetals, and methods for their preparation are described in U.S. Pat. Nos. 4,537,634; 4,547,580; and 4,656,296; each expressly incorporated herein by reference. Preferred glyoxal/polyol condensates can be prepared from polyols such as dextrans, glycerin, glyceryl monostearate, propylene glycol, ascorbic acid, erythorbic acid, sorbic acid, ascorbyl palmitate, calcium ascorbate, calcium sorbate, potassium sorbate, sodium ascorbate, sodium sorbate, monoglycerides of edible fats or oils or edible fat-forming acids, inositol, sodium tartrate, sodium potassium tartrate, glycerol monocaprate, sorbose monoglyceride citrate, polyvinyl alcohol, and their mixtures. Other suitable polyols include, but are not limited to, α-D-methylglucoside, sorbitol, and dextrose, and mixtures thereof.

In a preferred embodiment, the glyoxal/polyol condensate is commercially available from Sequa Chemicals, Inc., Chester, S.C., under the designation SEQUAREZ 755.

A cyclic urea/glyoxal/polyol condensate can be prepared by reacting glyoxal, at least one cyclic urea, and at least one polyol. These condensates and methods for their preparation are described in U.S. Pat. Nos. 4,455,416; 4,505,712; and 4,625,029; each expressly incorporated herein by reference. Preferred condensates can be prepared from cyclic ureas, including pyrimidones and tetra-hydropyrimidinones, such as ethylene urea, propylene urea, uron, tetrahydro-5-(2-hydroxyethyl)-1,3,5-triazin-2-one, 4,5-dihydroxy-2-imidazolidinone, 4,5-dimethoxy-2-imidazolidione, 4-methylethylene urea, 4-ethylethylene urea, 4-hydroxyethylethylene urea, 4,5-dimethylethylene urea, 4-hydroxy-5-methylpropylene urea, 4-methoxy-5-methylpropylene urea, 4-hydroxy-5,5-dimethylpropylene urea, 4-methoxy-5,5-dimethylpropylene urea, tetrahydro-5-(ethyl)-1,3,5-triazin-2-one, tetrahydro-5-(propyl)-1,3,5-triazin-2-one, tetrahydro-5-(butyl)-1,3,5-triazin-2-one, 5-methylpyrimid-3-en-2-one, 4-hydroxy-5-methylpyrimidone, 4-hydroxy-5,5-dimethylpyrimid-2-one, 5,5-dimethylpyrimid-3-en-2-one, 5,5-dimethyl-4-hydroxy-ethoxypyrimid-2-one, and the like, and mixtures of these; and 5-alkyltetra-hydropyrimidin-4-en-2-ones where the alkyl includes 1 to 4 carbon atoms, such as 5-methyltetrahydropyrimidin-4-en-2-one, 4-hydroxy-5-methyltetrahydropyrimidin-2-one, 4-hydroxy-5,5-dimethyltetrahydropyrimidin-2-one, 5,5-dimethyl-4-hydroxy-ethoxytetrahydropyrimidin-2-one, and mixtures of these. A preferred cyclic urea is 4-hydroxy-5-methyltetrahydropyrimidin-2-one. Preferred condensates include polyols such as ethylene glycol, diethylene glycol, 1,2-propylene glycol, 1,3-propylene glycol, 1,2-butylene glycol, 1,3-butylene glycol, 1,4-butylene glycol, polyethylene glycols having the formula $HO(CH_2CH_2O)_nH$ where n is 1 to about 50, glycerine, and the like, and their mixtures. Other suitable polyols include dextrans, glyceryl monostearate, ascorbic acid, erythorbic acid, sorbic acid, ascorbyl palmitate, calcium ascorbate, calcium sorbate, potassium sorbate, sodium ascorbate, sodium sorbate, monoglycerides of edible fats or oils or edible fat-forming acids, inositol, sodium tartrate, sodium potassium tartrate, glycerol monocaprate, sorbose monoglyceride citrate, polyvinyl alcohol, α-D-methylglucoside, sorbitol, dextrose, and their mixtures.

In a preferred embodiment, the cyclic urea/glyoxal/polyol condensate is commercially available from Sequa Chemicals, Inc. under the designation SUNREZ 700M.

A cyclic urea/glyoxal condensate can be prepared by reacting glyoxal with a cyclic urea as generally described above for the cyclic urea/glyoxal/polyol condensates. Suitable cyclic ureas include those noted above.

In a preferred embodiment, the cyclic urea/glyoxal condensate is commercially available from Sequa Chemicals, Inc. under the designation SEQUAREZ 747.

The cellulosic fibers to be crosslinked are treated with an aqueous solution of glyoxal and glyoxal-derived resin. The fibers are treated with an effective amount of glyoxal and glyoxal-derived resin to achieve the wet bulk enhancement described herein. Generally, the fibers are treated with from about 2 to about 8 percent by weight glyoxal and from about 2 to about 8 percent by weight glyoxal-derived resin based on the total weight of the treated fibers. In one preferred embodiment, fibers are treated with about 5 percent by weight glyoxal and about 5 percent by weight glyoxal-derived resin based on the total weight of the treated fibers. The wet bulk of fibers prepared from this combination using a representative cyclic urea/glyoxal/polyol condensate (i.e., SUNREZ 700M) was determined as described below and compared to commercially available high-bulk fibers. These crosslinked fibers exhibited a 60 percent wet-bulk enhancement compared to the commercial high-bulk fibers. The results are summarized in the Table 1 below.

As noted above, the present invention relates to crosslinked cellulose fibers. Although/available from other sources, cellulosic fibers are derived primarily from wood pulp. Suitable wood pulp fibers for use with the invention can be obtained from well-known chemical processes such as the Kraft and sulfite processes, with or without subsequent bleaching. The pulp fibers may also be processed by thermomechanical, chemithermomechanical methods, or combinations thereof. The preferred pulp fiber is produced by chemical methods. Ground wood fibers, recycled or secondary wood pulp fibers, and bleached and unbleached wood pulp fibers can be used. The preferred starting material is prepared from long-fiber coniferous wood species, such as southern pine, Douglas fir, spruce, and hemlock. Details of the production of wood pulp fibers are well-known to those skilled in the art. These fibers are commercially available from a number of companies, including Weyerhaeuser Company. For example, suitable cellulose fibers produced from southern pine that are usable with the present invention are available from Weyerhaeuser Company under the designations CF516, NF405, PL416, FR516, and NB416.

The wood pulp fibers useful in the present invention can also be pretreated prior to use with the present invention. This pretreatment may include physical treatment, such as subjecting the fibers to steam, or chemical treatment.

Although not to be construed as a limitation, examples of pretreating fibers include the application of fire retardants to the fibers, and surfactants or other liquids, such as water or solvents, which modify the surface chemistry of the fibers. Other pretreatments include incorporation of antimicrobials, pigments, and densification or softening agents. Fibers pretreated with other chemicals, such as thermoplastic and thermosetting resins also may be used. Combinations of pretreatments also may be employed.

The crosslinked fibers of the present invention can be prepared by applying a glyoxal crosslinking combination described above to a cellulosic fibrous mat or web; separating the treated fibrous web into individual, substantially unbroken fibers in a fiberizer; and then drying and then curing the individual treated fibers to provide glyoxal crosslinked fibers having high wet bulk.

In general, the cellulose fibers of the present invention may be prepared by a system and apparatus as described in U.S. Pat. No. 5,447,977 to Young, Sr. et al., which is incorporated herein by reference in its entirety. Briefly, the fibers are prepared by a system and apparatus comprising a conveying device for transporting a mat of cellulose fibers through a fiber treatment zone; an applicator for applying a treatment substance such as a glyoxal crosslinking combination from a source to the fibers at the fiber treatment zone; a fiberizer for completely separating the individual cellulose fibers comprising the mat to form a fiber output comprised of substantially unbroken cellulose fibers; and a dryer coupled to the fiberizer for flash evaporating residual moisture and for curing the crosslinking agent, to form dried and cured individualized crosslinked fibers.

As used herein, the term "mat" refers to any nonwoven sheet structure comprising cellulose fibers or other fibers that are not covalently bound together. The fibers include fibers obtained from wood pulp or other sources including cotton rag, hemp, grasses, cane, husks, cornstalks, or other suitable sources of cellulose fibers that may be laid into a sheet. The mat of cellulose fibers is preferably in an extended sheet form, and may be one of a number of baled sheets of discrete size or may be a continuous roll.

Each mat of cellulose fibers is transported by a conveying device, for example, a conveyor belt or a series of driven rollers. The conveying device carries the mats through the fiber treatment zone.

At the fiber treatment zone, the glyoxal crosslinking combination is applied to the cellulose fibers. The crosslinking combination is preferably applied to one or both surfaces of the mat using any one of a variety of methods known in the art, including spraying, rolling, or dipping. Once the crosslinking combination has been applied to the mat, the crosslinking combination may be uniformly distributed through the mat, for example, by passing the mat through a pair of rollers.

After the fibers have been treated with the crosslinking agent, the impregnated mat is fiberized by feeding the mat through a hammermill. The hammermill serves to separate the mat into its component individual cellulose fibers, which are then blown into a dryer. In a preferred embodiment, the fibrous mat is wet fiberized.

The dryer performs two sequential functions; first removing residual moisture from the fibers, and second curing the glyoxal crosslinking combination. In one embodiment, the dryer comprises a first drying zone for receiving the fibers and for removing residual moisture from the fibers via a flash-drying method, and a second drying zone for curing the crosslinking agent. Alternatively, in another embodiment, the treated fibers are blown through a flash-dryer to remove residual moisture, and then transferred to an oven where the treated fibers are subsequently cured. Overall, the treated fibers are dried and then cured for a sufficient time and at a sufficient temperature to effect crosslinking. Typically, the fibers are oven-dried and cured for about 15 to 20 minutes at 150° C. For the glyoxal/glycol combination, the cure time is preferably about 15 minutes and, for the glyoxal/glyoxal-derived resin combination, the cure time is preferably about 20 minutes.

The wet bulk of cellulosic fibers crosslinked with the glyoxal crosslinking combinations of the present invention was determined by the Fiber Absorption Quality (FAQ) Analyzer (Weyerhaeuser Co., Federal Way, Wa.) and reported in cc/g at 0.6 kPa using the following procedure.

In the procedure, a 4-gram sample of the pulp fibers is put through a pinmill to open the pulp and then air-laid into a tube. The tube is then placed in the FAQ Analyzer. A plunger then descends on the fluff pad at a pressure of 0.6 kPa and the pad height bulk determined. The weight is increased to achieve a pressure of 2.5 kPa and the bulk recalculated. The result, two bulk measurements on the dry fluff pulp at two different pressures. While under the 2.5 kPa pressure, water is introduced into the bottom of the tube (bottom of the pad). The time required for the water to reach the plunger is measured. From this, the absorption time and absorption rate are determined. The final bulk of the wet pad at 2.5 kPa is also measured. The plunger is then withdrawn from the tube and the wet pad allowed to expand for 60 seconds. The plunger is reapplied at 0.6 kPa and the bulk determined. The final bulk of the wet pad at 0.6 kPa is considered the wet bulk (cc/g) of the pulp product.

The wet bulk of the glyoxal crosslinked cellulosic fibers of the invention is compared to the wet bulk of commercially available high-bulk fibers (Columbus MF, Weyerhaeuser Co., citric acid crosslinked fibers) in the Table 1 below. In Table 1, percent enhancement refers to the increased wet bulk compared to the commercially available high-bulk fibers.

TABLE 1

Wet Bulk Enhancement of Glyoxal Crosslinked Fibers

| Crosslinking Combination | Wet Bulk (cc/g at 0.6 kPa) | Percent Enhancement |
|---|---|---|
| glyoxal/glycol | 24.9 | 47 |
| glyoxal/glyoxal-derived resin | 27.3 | 60 |
| citric acid | 17.0 | — |

As illustrated in the table, the glyoxal crosslinked cellulosic fibers of the present invention exhibit dramatically increased wet bulk compared to commercial high-bulk fibers.

The wet bulk of cellulosic fibers similarly crosslinked with the glyoxal combination including a representative glyoxal/polyol condensate (i.e., SEQUAREZ 755) is presented in Table 2 below. In these examples, the crosslinked fibers were obtained by crosslinking with a combination including about 6 percent by weight glyoxal and about 5 percent by weight glyoxal/polyol condensate based on the total weight of fibers. In Table 2, the wet bulk is shown as a function of cure temperature and time.

TABLE 2

Wet Bulk of Glyoxal Crosslinked Fibers

| | Wet Bulk (cc/g) | | |
|---|---|---|---|
| Cure Temperature/Time | 300° F. | 320° F. | 340° F. |
| 1 minute | 21.4 | 22.7 | 22.7 |
| 3 minutes | 23.0 | 23.1 | 24.0 |
| 5 minutes | 23.4 | 23.9 | 23.9 |

As shown in Table 2, wet bulk generally increases with increasing cure temperature and cure time. The results indicate that the glyoxal crosslinking combination of the invention provides high-bulk fibers at lower cure temperatures than for commercially available high-bulk fibers, which are crosslinked at about 380° F. for maximum fiber bulk.

The high-wet-bulk cellulosic fibers of the, present invention can be advantageously incorporated into an absorbent composite to impart wet bulk to the composite. Such composites can further include other fibers such as fluff pulp, synthetic fibers, and other crosslinked fibers, and absorbent materials such as superabsorbent polymeric materials. The high-wet-bulk fibers of the invention, or composites that include the high-wet-bulk fibers, can also be advantageously incorporated into diapers and, more particularly, into liquid acquisition and distribution layers to provide diapers having superior liquid acquisition rates, and liquid distribution and rewet properties.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A method for preparing individualized, crosslinked cellulosic having high wet bulk, comprising:

applying a glyoxal crosslinking combination to a cellulosic fibrous sheet, wherein the crosslinking combination comprises glyoxal, a glycol, and a crosslinking catalyst;

separating the fibrous sheet into individual fibers;

drying and then curing the individual fibers for sufficient time and at sufficient temperature to provide individualized, crosslinked cellulosic fibers having a wet bulk greater about 20 cc/g at 0.6 kPa.

2. The method of claim 1, wherein applying the glyoxal crosslinking combination comprises spraying an aqueous solution of the combination onto the fibrous sheet.

3. The method of claim 1, wherein separating the fibrous sheet into individual fibers comprises fiberizing in a hammermill.

4. The method of claim 1, wherein the temperature is about 150° C.

5. The method of claim 1, wherein the time is about 15 minutes.

6. The method of claim 1, wherein the time is about 20 minutes.

7. A method for preparing individualized, crosslinked cellulosic having high wet bulk, comprising:

applying a glyoxal crosslinking combination to a cellulosic fibrous sheet, the crosslinking combination consisting essentially of glyoxal and a crosslinking catalyst;

separating the fibrous sheet into individual fibers;

drying and then curing the individual fibers for sufficient time and at sufficient temperature to provide individualized, crosslinked cellulosic fibers having a wet bulk greater about 20 cc/g at 0.6 kPa.

8. The method of claim 7, wherein applying the glyoxal crosslinking combination comprises spraying an aqueous solution of the combination onto the fibrous sheet.

9. The method of claim 7, wherein separating the fibrous sheet into individual fibers comprises fiberizing in a hammermill.

10. The method of claim 7, wherein the temperature is about 150° C.

11. The method of claim 7, wherein the time is about 15 minutes.

12. The method of claim 7, wherein the time is about 20 minutes.

* * * * *